United States Patent [19]

Kuczma, Jr.

[11] 4,262,044

[45] Apr. 14, 1981

[54] METHOD FOR THE ELECTROLESS NICKEL PLATING OF LONG BODIES

[76] Inventor: John J. Kuczma, Jr., Poplar Creek Rd., Nashville, Tenn. 37201

[21] Appl. No.: 150,698

[22] Filed: May 16, 1980

Related U.S. Application Data

[62] Division of Ser. No. 919,211, Jun. 26, 1978, abandoned.

[51] Int. Cl.[3] ..... C23C 3/02

[52] U.S. Cl. ..... 427/438; 118/429; 427/345; 427/443.1

[58] Field of Search ..... 427/438, 345, 443.1; 118/429

[56] References Cited

U.S. PATENT DOCUMENTS

| | | | |
|---|---|---|---|
| 2,658,839 | 11/1953 | Talmey et al. | 118/429 |
| 2,717,218 | 9/1955 | Talmey | 118/429 |
| 2,791,516 | 5/1957 | Chambers et al. | 118/429 |
| 2,819,188 | 1/1958 | Metheny et al. | 118/429 |
| 2,874,073 | 2/1959 | Metheny et al. | 118/429 |
| 2,946,698 | 7/1960 | Brunnick et al. | 118/429 |
| 2,956,900 | 10/1960 | Carlson et al. | 427/438 |
| 3,247,013 | 4/1966 | Spraul et al. | 427/438 |
| 3,556,839 | 1/1971 | Roy | 118/429 |
| 3,620,813 | 11/1971 | Minbiole | 118/429 |
| 3,664,354 | 5/1972 | Minbiole | 118/429 |
| 3,727,680 | 4/1973 | Henry | 118/429 |
| 3,853,094 | 12/1974 | Christini et al. | 118/429 |
| 3,870,068 | 3/1975 | Dutkewych et al. | 118/429 |
| 4,143,618 | 3/1979 | Vecchio | 118/429 |
| 4,150,180 | 4/1979 | Potapov et al. | 118/429 |

*Primary Examiner*—John D. Smith

*Attorney, Agent, or Firm*—Harrington A. Lackey

[57] ABSTRACT

A method and apparatus for the electroless nickel plating of long bodies including a deep tank capable of supporting at least one long body in a substantially vertical position and immersed in an electroless nickel plating solution, a fluid distribution system including a plurality of vertically spaced sparger outlets within the tank and means for discharging filtered, heated, plating solution through the sparger outlets generally directed toward or around the long body within the tank to provide directionalized dispersion of the solution throughout substantially the full depth of the tank.

8 Claims, 8 Drawing Figures

METHOD FOR THE ELECTROLESS NICKEL PLATING OF LONG BODIES

CROSS REFERENCE TO RELATED APPLICATION

This is a division of application Ser. No. 919,211 filed June 26, 1978, now abandoned.

BACKGROUND OF THE INVENTION

This invention relates to an electroless nickel plating method and apparatus, and more particularly to a method and an apparatus for the electroless nickel plating of long bodies.

Although electroless nickel plating of bodies of all types is known, nevertheless bodies of exceptional length, such as pipes, tubes or pump bodies are difficult to plate uniformly.

Conveniently, long bodies or articles, such as tubes and pipes, are supported horizontally within an elongated plating tank. The electroless nickel plating solution is heated, and sometimes agitated, to plate the horizontal body immersed within the solution in the tank. Foreign particles in the bath or solution tend to gravitate down upon the upper exposed surfaces of the body. Such foreign particles deposited upon the upper surfaces tend to plate upon the surfaces by virtue of an auto-catalytic reduction reaction. Thus, the particulate matter co-deposits with the plating material, so that the overall coating of the object is non-uniform.

Hydrogen bubbles, which are by-products of the electroless solution reaction, have a tendency to rise and adhere to lower exposed surfaces. Where the hydrogen bubbles adhere to the surface, there is little, if any, plating action by the electroless nickel solution. Accordingly, such areas are thinly plated.

Similar, but accentuated, deposits of particulate matter and voids from hydrogen bubbles occur on the interior surfaces of bodies, such as the interior opening of a long pipe, through which circulation of the solution is difficult, particularly at the same flow rate as the solution on the exterior surfaces of the bodies. The longer the bodies, the more non-uniform the plating is apt to be.

Furthermore, exceptionally long bodies present space problems, as well as additional manufacturing costs in producing very long horizontal plating tanks.

Where there is considerable weight in the long body to be plated, more supports must be provided in order to prevent the long body from bending or bowing. Where additional supports or brackets are provided for mounting the long body within the tank to maintain the longitudinal axis of the body in a substantially straight line, then those areas of the body engaging the supports will not be plated.

SUMMARY OF THE INVENTION

It is therefore an object of this invention to provide a unique method and apparatus for the electroless nickel plating of substantially long bodies, such as pipes, tubular members and pump housings, in which such bodies are supported within a tall or deep plating tank in a substantially vertical position. The effect of gravity upon foreign particles as well as the effect of rising hydrogen bubbles in the electroless nickel solution will minimize the deposit problems associated with such particles and bubbles upon the surfaces of the long body, and therefore tend to provide a more uniform continuous plating.

The invention further contemplates a fluid conduit or tube having vertically spaced sparger outlets for directing the flow of electroless nickel solution substantially uniformly throughout the height of the body received within the plating tank.

More specifically, the apparatus including a plating tank of substantial height, and made of a material, which is not only insulative, but also inert of the plating out or chemical reaction to the electroless nickel plating solution. The height of the tank is such that the long body to be plated will be completely received within the tank in a substantially vertical position and substantially immersed in the plating solution within the tank.

A fluid distribution system is provided in the form of a pump, filter device, heat exchanger for heating the electroless nickel solution, and a sparger tube or pipe having vertically spaced outlets within the tank and directed generally toward the long body to be plated.

The pump, heat exchanger and sparger tube are so designed that uniform temperature, concentration and pH of the electroless nickel solution is maintained substantially throughout the depth of the solution within the tank.

DESCRIPTION OF THE PREFERRED EMBODIMENT

Figures 1, 2, 3, 4, 5, 6, 7, 8:
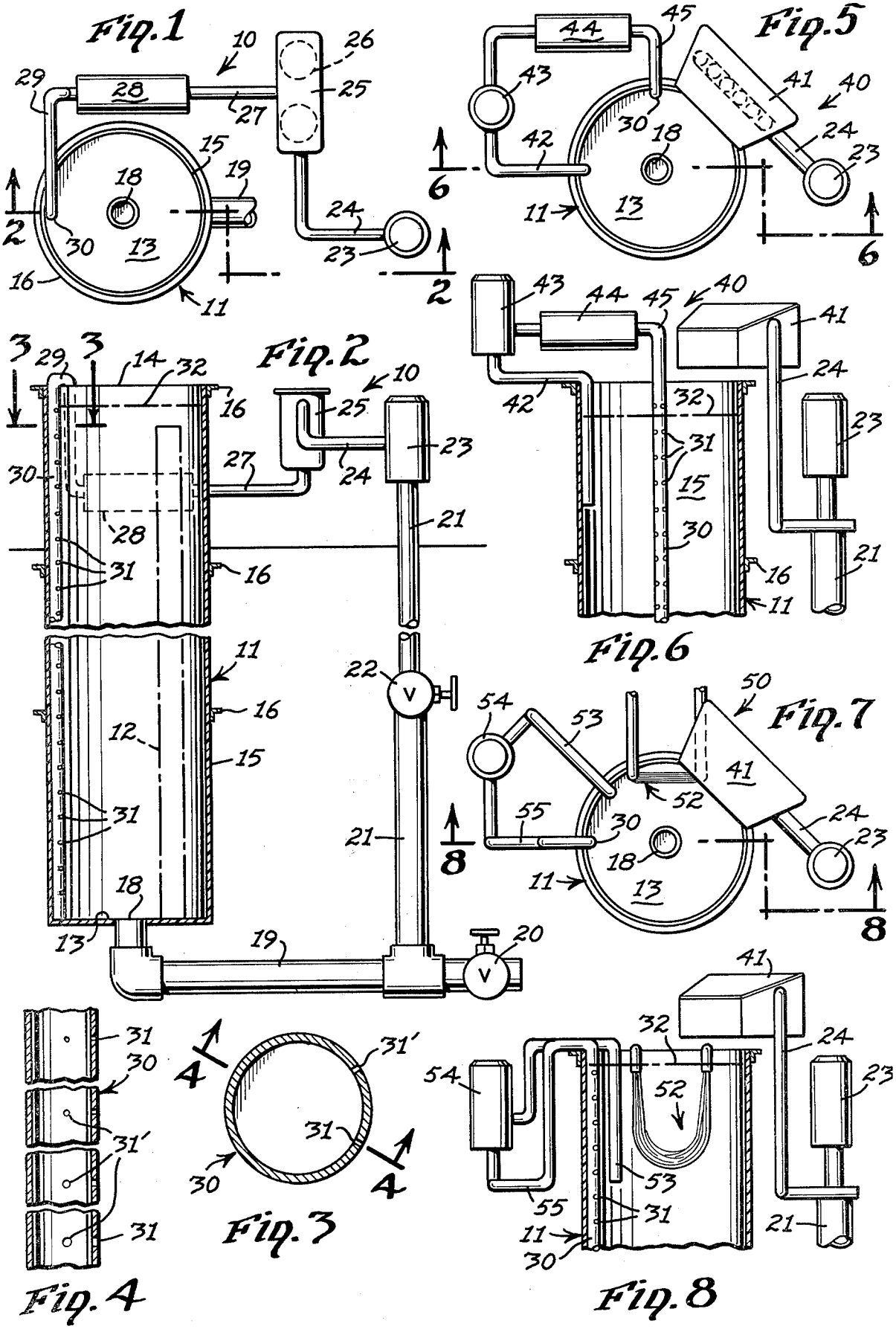
FIG. 1 is a top plan view of one form of the apparatus, with parts broken away.
FIG. 2 is a section taken along the line 2—2 of FIG. 1.
FIG. 3 is a substantially enlarged section of the sparger tube taken along the line 3—3 of FIG. 2.
FIG. 4 is a reduced section taken along the line 4—4 of FIG. 3, with portions broken away.
FIG. 5 is a top plan view of a first modified form of the apparatus.
FIG. 6 is a section taken along the line 6—6 of FIG. 5.
FIG. 7 is a top plan view of a second modified form of the apparatus.
FIG. 8 is a fragmentary section taken along the line 8—8 of FIG. 7.

Referring now to FIGS. 1–4, the apparatus 10 includes an elongated plating tank 11, whose longitudinal axis is disposed vertically. The height of the tank 11 is sufficient to receive a long body, such as en elongated pipe 12, disclosed in phantom in FIG. 2, in a vertical position completely submerged below the surface 32 of the electroless nickel solution within the tank 11, for plating the entire pipe or body 12. The plating tank 11 may be cylindrical or any other desired shape having a closed bottom wall 13 and an open top 14 with a cylindrical side wall 15. The tank 11 is preferably made of an ultra-high molecular polyethylene material in which the bottom wall 13 is fused to the cylindrical side wall 15. The plating tank 11 may be supported are reinforced by the frame member 16. The plating tank 11 may also be insulated within an insulating jacket, not shown, to maintain the high temperature of the plating solution within the tank 11, if desired.

Connected in fluid communication with a drain opening 18 in the bottom wall 13 is a drain pipe 19 having a drain discharge valve 20. When the drain discharge valve 20 is closed, the solution passing through the drain pipe 19 is recirculated upward through the pump intake line 21 and valve 22 to the pump 23.

The pump 23 is especially designed to move the electroless nickel solution through the circulation of distribution system including the intake line 21 and the pump discharge line 24 at a high rate of flow. The electroless nickel solution passes through a filter apparatus 25 from the pump discharge line 24, where the solution is filtered, such as through conventional bag filters 26. The filtered solution then moves through the pipe into heat exchanger 28 27, where the solution is heated, by any convenient means to a temperature which will provide a temperature within the plating tank 11 of a predetermined value, such as 190° F. The filtered heated solution then discharges from the heat exchanger 28 through conduit 29 into a sparger pipe 30.

The sparger pipe 30 preferably extends the full height of the plating tank 11 in a vertical position, and is provided with a plurality of vertically spaced sparger outlets or apertures 31, 31'. The arrangement of the sparger outlets 31 is such as to direct a forced flow of electroless nickel solution directly toward, or tangentially adjacent to, the body 12 to be plated within the plating tank 11.

In a preferred form of the invention, the sparger outlets 31 are uniformly vertically spaced, but vary in size or diameter, gradually becoming larger from the top to the bottom of the sparger pipe 30. Since the heated electroless nickel solution rises, the purpose of the graduated sizes of the openings of the sparger outlets 31 is to provide a vertically graduated discharge so that more heated solution is discharged at deeper levels. If the flow discharge were vertically uniform throughout the height of the tank 11, there would be more heated solution at the upper levels of the tank than at the lower levels, which would create uneven plating. Thus, more heated solution has to be discharged at the lower levels than at the upper levels, and the amounts of fluid discharge must increase progressively downward.

As best disclosed in FIGS. 3 and 4, two vertical rows of sparger outlets 31 and 31' are formed in the sparger pipe 30 to provide two vertical streams of discharge fluid directed at horizontal radial angles to each other. Such diverging flow patterns will assure proper dispersion of the electroless nickel solution on both sides of the vertically disposed body 12 to be plated.

The apparatus 10 is adapted to plate extremely long bodies disposed in a vertical position, as opposed to the previous methods of plating long bodies disposed horizontally.

The apparatus 10 is designed to plate vertically disposed bodies 12 where the length of the body 12, or the depth of the tank 11, extends below approximately the first atmosphere pressure region, and into the second atmosphere fluid pressure region, or, at least, approximately 34 feet.

When a long body 12 is plated with an electroless nickel solution utilizing the applicant's apparatus 10, with the long body 12 disposed in a vertical position, all surfaces at any level are plated substantially equally, since the force of gravity acts equally upon all vertical surfaces of the body 12 at any level when the body 12 is in a vertical position. Any foreign matter falls to the bottom of the tank 11, without depositing upon the vertical surface of the pipe 12.

Even where the body 12 incorporates horizontal protuberances having top and bottom surfaces, such surfaces are minimal compared with the surfaces of a horizontally extending body. Moreover, the forced flow of solution from the sparger pipe 30 provides sufficient agitation to prevent "shelving", or overplating top horizontal surfaces. The discharge through the sparger outlets 31 and 31' will maintain a substantially uniform and agitated flow pattern to prevent deposits of foreign particles or hydrogen bubbles upon any of the surfaces, either vertical or horizontal, top or bottom.

The electroless nickel solution is conventional or typical, and includes nickel sulphate, sodium hypophosphite and organic complexing acids, such as acetic acid and citric acid.

The apparatus 10 now permits parts and bodies of great length and/or abnormal configuration to be plated with electroless nickel solution in a vertical position. Such a process of electroless nickel plating is far superior to previous methods, not only because of the vertical positioning of the body in a plating tank of substantial height, but also because of the agitated flow pattern permitted by the especially designed sparger pipe 30. The apparatus 10 enables the plating process to be carried out with minimum temperature gradients and with minimal particulate matter deposits upon the plated surfaces. The build-up of plating solution upon some surfaces, as well as the thin plating accompanying the adherence of hydrogen bubbles, is substantially minimized.

In the modified apparatus 40 disclosed in FIGS. 5 and 6, the same plating tank 11, sparger pipe 30, pump 23 and pump lines 21 and 24 are employed. The electroless nickel solution is forced by the pump 23 through the discharge line 24 to a different type, yet still conventional, filter device 41. The filtered solution is discharged directly through a suction line 42, disposed below the solution surface 32, and suction pump 43 to a heat exchanger 44, where the heated solution is then discharged through intake line 45 into the sparger pipe 30. The sparger pipe 30 is of the same construction as the sparger pipe 30 in the apparatus 10, but is disclosed in a slightly different position. The body to be plated, not shown in FIGS. 5 and 6, is disposed in the plating tank 11 in such a position that the sparger outlets 31 and 31' will discharge the electroless nickel solution toward the body in the optimum dispersion pattern for effective plating of the body.

Except for the modified elements disclosed in FIGS. 5 and 6 in the apparatus 40, the apparatus 40 operates in substantially the same manner as the apparatus 10.

In the modified apparatus 50 disclosed in FIGS. 7 and 8, the elements are substantially the same as those disclosed in FIGS. 5 and 6 of the apparatus 40, except the heat exchanger 52 is of a different type and located in the flow pattern in a different manner. The heat exchanger 52 is a super coil of the type manufactured by the E.I. DuPont de Nemours Company, provided with a plurality of numerous tiny plastic pipettes through which steam is discharged to provide a multiple number of heat exchange surfaces below the solution surface 32 in the tank 11. The heated solution is picked up by the suction pipe 53 by a secondary suction pump 54 and discharged through the intake line 55 directly into the sparger pipe 30 of the apparatus 50. Otherwise, the apparatus 50 functions in the same manner as the apparatuses 40 and 10.

A typical discharge rate for the pump 23 is approximately 300 gal. per minute.

Examples of different types of long tubes, pipe or bodies 12 which can be effectively treated in the vertical position in the apparatuses 10, 40 and 50, are long oil pipes, oil pump bodies, heat exchanger tubes, long liquid pressure vessels, and many other long-bodied products.

What is claimed is:

1. A method for electroless nickel plating a relatively long body having a longitudinal axis, comprisimg the steps of:

(a) completely immersing said long body in a bath of an electroless nickel plating solution within a deep plating tank, and positioning said long body so that the longitudinal axis of said long body is substantially vertical, (b) heating said electroless nickel solution to a predetermined, substantially uniform temperature, (c) immersing a fluid conduit having a plurality of vertically spaced sparger outlets in said bath and spaced from said long body, (d) directing said sparger outlets generally toward said long body, (e) forcing said electroless nickel solution through said fluid conduit to discharge said solution through said sparger outlets in streams flowing against said long body throughout its vertical length.

2. The method according to claim 1 further comprising the step of filtering said plating solution prior to the discharge of said solution through said sparger outlets.

3. The method according to claim 1 in which the streams of solution discharged through said sparger outlets increase in size from the top to the bottom of said bath.

4. The method according to claim 3 in which said sparger outlets are uniformly vertically spaced within said tank, and in which the size of said sparger outlets increases uniformly from the top to the bottom of said fluid conduit.

5. The method according to claim 1 further comprising the step of arranging said sparger outlets in a plurality of laterally spaced vertical rows so that said forcing step discharges substantially horizontal streams of solution from said sparger outlets, said streams from one vertical row of sparger outlets discharging in horizontal directions different from the horizontal directions of the streams discharging from the sparger outlets in any other vertical row.

6. The method according to claim 1 further comprising the step of maintaining the electroless nickel solution within said plating tank at a substantially uniform temperature, concentration and pH.

7. The method according to claim 1 in which the length of said long body immersed in said bath is at least approximately 34 feet.

8. The method according to claim 1 in which the length of said body immersed in said bath is long enough to extend to a depth in the bath where the fluid pressure is at least approximately one atmosphere.

* * * * *